US007896259B2

(12) United States Patent
Meisner et al.

(10) Patent No.: US 7,896,259 B2
(45) **Date of Patent: *Mar. 1, 2011**

(54) MULTIFUNCTION SHOWERHEAD WITH AUTOMATIC RETURN FUNCTION FOR ENHANCED WATER CONSERVATION

(75) Inventors: David Meisner, Monmouth Beach, NJ (US); Walter Pitsch, Washington, NJ (US); Tung Hsien Lu, Taiping (TW)

(73) Assignee: As IP Holdco, L.L.C., Piscataway, NJ (US)

( * ) Notice: Subject to any disclaimer, the term of this patent is extended or adjusted under 35 U.S.C. 154(b) by 856 days.

This patent is subject to a terminal disclaimer.

(21) Appl. No.: 11/581,666

(22) Filed: Oct. 16, 2006

(65) Prior Publication Data

US 2008/0087746 A1 Apr. 17, 2008

Related U.S. Application Data

(60) Provisional application No. 60/791,747, filed on Apr. 13, 2006.

(51) Int. Cl.
*B05B 1/34* (2006.01)

(52) U.S. Cl. ..... 239/383; 239/72; 239/73; 239/443; 239/558

(58) Field of Classification Search ..... 239/380–383, 239/442–449, 556, 558, 559, 562, 563, 564, 239/72, 73

See application file for complete search history.

(56) References Cited

U.S. PATENT DOCUMENTS 3,485,451 A 12/1969 Gore et al.
3,801,019 A 4/1974 Trenary et al.
3,958,756 A 5/1976 Trenary et al.
4,079,891 A 3/1978 Kwan
4,190,207 A 2/1980 Fienhold et al.
4,303,201 A 12/1981 Elkins et al.
4,346,844 A 8/1982 Harmony
4,588,130 A 5/1986 Trenary et al.
5,215,258 A 6/1993 Jursich
5,294,054 A 3/1994 Benedict et al.
5,316,216 A 5/1994 Cammack et al.
5,551,637 A * 9/1996 Lo ..... 239/394

(Continued)

OTHER PUBLICATIONS

International Search Report and Written Opinion issued on Nov. 24, 2008 for the corresponding International Application No. PCT/US08/77464.

(Continued)

*Primary Examiner*—Christopher S Kim
(74) *Attorney, Agent, or Firm*—Flaster/Greenberg, P.C.

(57) ABSTRACT

The present invention provides a water saving showerhead that allows a bather to switch among at least three different water delivery functions. In the first function, the showerhead delivers a concentrated fluttering spray. In the second function, the showerhead delivers a combined spray pattern, wherein the fluttering spray and a radially dispersed precision spray are simultaneously delivered to the bather. In the third function, the showerhead delivers the precision spray pattern. The combination spray pattern is effected without compromising either the desirable massaging and cleaning effect of water delivery or the inherent water conservation benefits. In addition, the showerhead of the present invention provides an automatic return feature for return of the showerhead to the first function when water pressure to the showerhead falls below a predetermined bottom threshold.

27 Claims, 8 Drawing Sheets

U.S. PATENT DOCUMENTS

| | | | |
|---|---|---|---|
| 5,577,664 | A | 11/1996 | Heitzman |
| 5,625,688 | A | 4/1997 | Ford et al. |
| 5,918,811 | A | 7/1999 | Denham et al. |
| 5,938,123 | A | 8/1999 | Heitzman |
| 6,126,091 | A | 10/2000 | Heitzman |
| 6,659,372 | B2 | 12/2003 | Marsh et al. |
| 6,739,523 | B2 | 5/2004 | Haverstraw et al. |
| 7,066,407 | B2 | 6/2006 | Lu |
| 2004/0199993 | A1 | 10/2004 | Bui |

OTHER PUBLICATIONS

Reference co-pending U.S. Appl. No. 12/239,763, filed Sep. 2008, Meisner et al.

* cited by examiner

MULTIFUNCTION SHOWERHEAD WITH AUTOMATIC RETURN FUNCTION FOR ENHANCED WATER CONSERVATION

CROSS-REFERENCE TO RELATED APPLICATIONS

This application claims the benefit under 35 U.S.C. §119 (e) of U.S. Provisional Patent Application No. 60/791,747, filed Apr. 13, 2006.

BACKGROUND OF THE INVENTION

1. Field of the Invention

The present invention is directed to a multifunctional showerhead assembly that accommodates at least two water flow patterns to achieve optimal water conservation. More particularly, the present invention is a dual flow showerhead incorporating an impeller for delivery of discrete water droplets in a radial pattern such that an inner pattern delivers a concentrated spray at a first predetermined flow rate and an outer pattern delivers a radiating spray at a second, higher predetermined flow rate. Both sprays may be employed such that the combined flow rate delivered by the showerhead does not exceed the second predetermined flow rate, thereby achieving tactilely desirable flow without excessive water consumption.

2. Description of Related Art

Individuals have long recognized the therapeutic benefits of massage for treatment of numerous physical and psychological maladies and also for attainment of general wellness. Massage in its numerous forms is a well-accepted means of reducing stress and aiding relaxation, relieving muscle tension and stiffness, enhancing athletic performance, alleviating depression and anxiety, reducing exacerbated respiratory and pulmonary rates, lowering blood pressure, alleviating musculoskeletal pain, increasing blood circulation and lymph flow, improving range of motion, enhancing health and nourishment of the skin and increasing endorphins (source: American Massage Therapy Association, www.amtamassage.org). As people all over the world engage in increasingly hectic schedules, there is an escalating need and desire for pampering and treatment from readily accessible sources found in the home and workplace.

Sanitary manufacturers increasingly recognize consumers' desire to derive the benefits of massage during daily activities such as bathing and showering. Delivery of water to the skin is inherently pleasant and provides the potential for enhanced pampering, rather than mere cleansing, in the bathroom. Such manufacturers have developed numerous sanitary products, such as showerheads and handsprays, which generate various massage effects (i.e., shiatsu, acupressure, deep tissue, etc.) and deliver such effects in combination with a plurality of water delivery options (i.e., hard and soft pulsing sprays, widely dispersed sprays, concentrated sprays, etc.).

See, for instance, U.S. Pat. No. 3,485,451 to Gore et al. ("Gore") that discloses a shower head for simultaneous discharge of water in two different patterns. An outer spray stream is discharged in a pulsating linear direction so as to assume a conical hollow shape, and an inner stream is discharged in a rotating helix. Gore achieves this dual stream delivery via employment of a rotatable rotor that is actuated via fluid force of water passing through the showerhead.

U.S. Pat. Nos. 3,801,019 and 3,958,756, both to Trenary et al., disclose a shower head that delivers three types of sprays upon selection of the user. In a first operating mode, the disclosed shower head provides an all-continuous spray in which all water from the shower head is discharged in continuous uninterrupted streams. In a second operating mode, the shower head delivers an all-pulsating spray wherein all water is discharged in pulsating or cyclically interrupted streams. In a third operating mode, the user can select a combination spray, wherein a portion of the water is delivered in continuous streams while the remaining portion is discharged as a pulsating spray. A rotating impeller is employed to effect pulsating water delivery in the second and third operating modes, wherein the rate of impeller rotation may be altered to achieve corresponding fluctuation in pulsation, as desired by the user.

U.S. Pat. No. 4,079,891 to Kwan discloses a spray nozzle for a showerhead wherein a rotating turbine provides a pulsating spray in combination with structure that provides a continuous spray. The spray nozzle is controlled by a user to deliver one of the continuous spray, the pulsating spray or a variable combination of both spray types.

U.S. Pat. No. 5,294,054 to Benedict et al. discloses an adjustable showerhead assembly that is operable in a push-pull manner to obtain one of several spray characteristics. A first operation mode delivers a whirling massage action wherein fluid discharge nozzles are rotatably carried by a rotating outer housing, and a second operation mode wherein the outer housing remains fixed to provide a conventional shower spray pattern. An impeller disposed in the outer housing effects rotation thereof via delivery of water through the showerhead assembly. The turbine member can assume one of several embodiments, including but not limited to blades or turbine wheels, arcuate conduits and molded fluid conveying channels. The showerhead assembly may be modified by incorporating a pressure regulator that restricts, but does not terminate, water flow upon experiencing an increase in water pressure. The showerhead assembly thereby achieves both operational modes while conserving water resources.

Although the aforementioned devices successfully deliver desirable massage effects to the user, none of the disclosed devices addresses the increasing need for water conservation. The excessive consumption of potable water remains a dilemma for water agencies, commercial building owners, homeowners, residents, members of the hospitality industry and sanitaryware manufacturers. An increasing global population has negatively affected the amount and quality of suitable water. Effluents in water supplies and increasing air pollutants have drastically altered fresh water supplies. The propensity for drought in previously fertile geographies has reinforced global concern over responsible water consumption. The drive for optimum water conservation strategies, however, typically yields to the overriding need to sustain a healthy population through the enactment and enforcement of plumbing codes and the installation of sanitary plumbing fixtures that are compliant therewith.

In an effort to execute water conservation strategies, many sanitaryware manufacturers have introduced a variety of low water fittings such as showerheads, faucets, bath fillers and the like (collectively, "sanitary fittings"). It is well understood that bath shower valves deliver water to showerheads in excessive amounts that must be restricted or otherwise controlled at the showerhead output. In a common household, wherein two-thirds of all indoor water use is attributable to bathing and toilet flushing, installation of water conservation devices comprises an important step toward water efficiency. Showerheads that conserve water are particularly desirable, since such showerheads typically use 2.5 gallons per minute (GPM) or less at 80 PSI (as compared with 50 to 80 gallons consumed during an average bath) (see ANSI Standard A112.18.1-2003 which establishes the maximum flow rate for showerheads). Many such designs still use an inordinate amount of water, especially in consideration of contemporary water conservation efforts.

Multiple efforts have been made to provide sufficient water delivery for bathing without compromising water conservation objectives. U.S. Pat. No. 4,190,207 to Feinhold et al., for example, discloses a pulsating spray nozzle for a shower head that employs a forced-vortex turbine. The turbine has a plurality of blades that are driven by water impinging thereon such that the rate of rotation is dependent upon the water flow rate. The spray nozzle operates in continuous, pulsating and combination spray modes via operation of a control ring in communication with a shutter plate that selectively obstructs fluid flow corresponding to actuation of the control ring. A regulator is provided that limits the water flow rate to a predetermined maximum (disclosed at about 1.8 GPM) upon an increase in water pressure beyond a selected level.

U.S. Pat. No. 4,303,201 to Elkins et al. ("Elkins") discloses a showering system that delivers steam in combination with a continuous, pulsating or combination spray pattern. A control plate allows the user to select the desired spray pattern, speed of pulsation (i.e. fast and slow) and degree of pulse perception (i.e., hard and soft) to achieve a desired massage effect. In a preferred embodiment, the Elkins shower system delivers approximately 3.7 GPM in a hard pulse mode and 2.0 GPM in a soft pulse mode (although Elkins does not address whether separate spray streams can be limited to a maximum flow rate so as to limit the overall flow rate of the showerhead to a predetermined maximum).

U.S. Pat. No. 4,346,844 to Harmony discloses an aerated pulsating shower head wherein a stream of water is split into two paths and the proportional water flow in each path is selectively variable. The first water path is discharged in the form of a cone-shaped spray, and the second water path is delivered to a chamber having a rotor disposed therein for pulsating water delivery. At an upstream location of the split in the water path, an introduction of air reduces the quantity of water flow without an apparent ware flow reduction felt by the user.

U.S. Pat. No. 4,588,130 to Trenary et al. discloses a showerhead having multiple operational modes to selectively deliver continuous, pulsating and combination sprays. Pulses may be selectively delivered in fast and slow modes such that, in the fast mode, the showerhead delivers about 1.9 GPM.

U.S. Pat. No. 5,215,258 to Jurisch discloses a showerhead having selective operational modes effected by employment of a turbine member. A spray pattern head orbits a central location in the showerhead upon rotation of a spray selection dial to distribute water over a user's body without exceeding a showerhead delivery rate of 2.5 GPM.

U.S. Pat. Nos. 5,577,664, 5,938,123 and 6,126,091 to Heitzman disclose a showerhead having variable flow rates, pulsation and spray patterns available for selection by a user. U.S. Pat. No. 5,577,664 discloses a showerhead having a selective automatic cycling feature wherein the flow rates cycles between high and low flow rates to realize water savings up to 25% over prior art showerheads and simultaneously provide different spray sensations to the user. The cycling flow rate is used in combination with a water pulsation function that fluctuates between high and low pulsation rates (although full pulsation mat be selected without cycling) and/or concentrated and wide spray patterns.

A pair of rotary valve members is provided, each having a turbine wheel driven by waster flow through the showerhead. The disclosed showerhead can cycle between a low flow rate such as 2.25 GPM and a high flow rate such as 3.0 GPM during the cycle.

U.S. Pat. No. 5,938,123 to Heitzman discloses a showerhead having continuous or cycling flow rates either alone or in combination with fast or slow pulsations and/or variable spray patterns. A pulsating turbine is provided as disclosed in U.S. Pat. No. 5,577,664 of Heitzman such that rotation of a control ring effects the desired spray effect at the desired rates of pulsation and flow. At low pulsation speeds, the water cycle produces a flow rate of between about 3.5 GPM and 1.5 GPM, resulting in a desired average of 2.5 GPM for the duration of the cycle.

U.S. Pat. No. 6,126,091 to Heitzman discloses a showerhead with variable pulsation and flow rates incorporating the turbine member of U.S. Pat. No. 5,577,664. The showerhead includes a housing and a valve body having axial and diametrical ports extending therethrough.

The valve member is eccentrically positioned such that the water flow rate between a high flow rate such as 3.5 GPM and a low flow rate such as 1.5 GPM when housing ports and valve body ports are in alignment (during the lowest water flow rate, the flow rate will vary, for example, between 2.5 GPM and 1.0 GPM to provide an average flow rate of 1.75 GPM). When a user desires to bypass the variable flow rate function, a continuous flow of 2.5 GPM may be selected. The variable flow rates provide different shower sensations of differing intensity without exceeding the generally accepted water delivery limits of 2.5 GPM during cycling.

The above cited devices and their conventional counterparts achieve their water conservation objectives without sacrificing the option to combine showerhead functions (i.e., selection of continuous, pulsating and combination sprays at variable flow rates and arrays). These water conservation showerheads, however, require the bather to select between a concentrated spray pattern (which is desirable to target specific regions on the body) and a radial or "normal" spray pattern (typically desired for total body coverage) regardless of desired flow rate. The disclosed flow rates of these devices are obtained by taking an average along all spray modes, thereby continuing the undesirable overconsumption of potable water.

In addition, none of these devices incorporates an automatic return function wherein the showerhead, at the conclusion of a shower event, automatically returns to a water conservation mode. In this mode, the shower disperses the lowest flow volume to realize optimal water conservation benefits. A showerhead that automatically returns to this mode will, at the initiation of subsequent shower events, immediately operate in the water saver mode. A showerhead can be adapted to operate in this mode at the start of each shower event and simultaneously provide desired water massaging effects while in this mode.

It is therefore desirable to provide a showerhead that substantially reduces consumption of potable water without comprising showerhead performance. It is further desirable to provide a showerhead that automatically returns to a water conservation mode yet generates pleasing massage effects while in that mode. Such a showerhead uses minimal water amounts to achieve multiple effective spray patterns and thereby maintain optimal functionality.

BRIEF SUMMARY OF THE INVENTION

It is an advantage of the present invention to provide a showerhead assembly that realizes optimum water conservation.

It is another advantage of the present invention to provide such a showerhead assembly with multiple shower spray modes without sacrificing the assembly's advantageous conservation features.

It is a further advantage of the present invention to provide a showerhead assembly to achieve dual water flow capability in combination with the multiple water spray modes.

It is still a further advantage of the present invention to provide a showerhead assembly that automatically assumes a water conservation mode upon initiation of showerhead operation.

In the achievement of these and other advantages, the present invention provides a showerhead wherein a dial, lever, button or other actuation member allows a bather to switch among at least three different water delivery functions. The first function comprises sole delivery of a concentrated fluttering spray by a turbine at a first predetermined lower water flow rate not to exceed 1.5 GPM. The second function comprises delivery of a combined spray pattern, wherein the fluttering spray and a radially dispersed precision spray are simultaneously delivered to the bather at a second predetermined water flow rate not to exceed 2.5 GPM for the combined water flow. The third function comprises delivery of the radially dispersed precision spray through corresponding spray apertures at a third predetermined water flow rate not to exceed 2.5 GPM. The combination spray pattern is effected without compromising either the desirable massaging and cleaning effect of water delivery or the inherent water conservation benefits.

In addition, the showerhead of the present invention provides an automatic return feature wherein the showerhead instantly returns to its first optimal water saving mode upon completion of a shower event. The showerhead of the present invention is initially set to the first water saver mode to provide a desirable massaging spray to the user. In selecting among the three spray modes, the user receives tactile feedback that ensures proper selection of the desired mode and thereby prohibits undesirable water usage. The user also receives visual confirmation via alignment of an actuation member and at least one index corresponding to at least one of the spray modes. When water delivery to the showerhead is discontinued, or alternatively when water pressure falls below a predetermined bottom threshold, the showerhead automatically returns to its initial position in the water saving mode to eliminate the waste of potable water during consecutive shower events. Such conservation measures are achieved without detriment to the pleasing sensations delivered in each of the three spray modes.

The present invention showerhead can assume the aesthetic appearance and size of conventional showerheads so that the invention is readily installed in existing commercial or residential bathrooms, hotels, hospitality venues, locker rooms and the like. The present invention can therefore also coexist alongside conventional showerheads or completely replace such showerheads without changing the number of showerheads or the structural integrity of the water delivery system in fluid communication therewith.

Various other advantages and features of the present invention will become readily apparent from the following detailed description.

BRIEF DESCRIPTION OF THE SEVERAL VIEWS OF THE DRAWING(S)

DETAILED DESCRIPTION OF THE INVENTION

Figure 1:
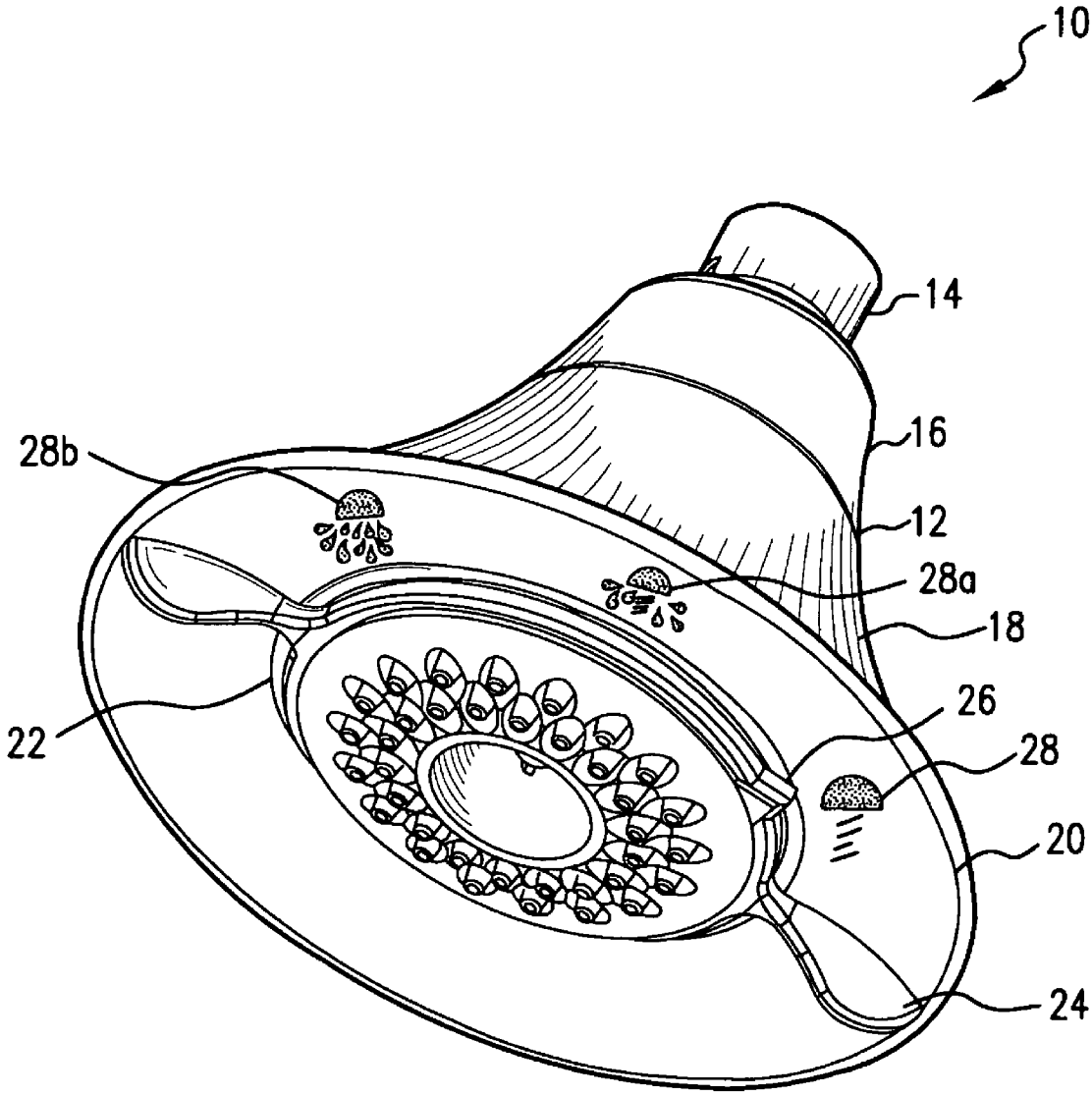
FIG. 1 shows a perspective view of a multifunction showerhead according to the present invention.

Now referring to the figures, wherein like numerals identify like elements, FIG. 1 shows a showerhead 10 of the present invention having a housing 12 pivotably secured to a ball joint 14. Housing 12 includes a shell nut 16 that may be integral with or detachably fastened to one or both of an intermediate main shell portion 18 and an outer face plate 20, all of which cooperate to accommodate the operative elements of showerhead 10. Although housing 12 is shown in a generally frustoconical configuration, it is understood that housing 12 or any portion thereof can assume any geometry or aesthetic effect that facilitates successful operation of the present invention.

Outer face plate 20 forming part of the showerhead housing is provided at a distal extent 18*b* of main shell 18 and has a rotatable actuation member 22 operative thereadjacent. Actuation member 22 is provided in freely rotatable registry with outer face plate 20 and includes at least one grasping portion 24 that accommodates placement of one or more digits thereon and effects rotation of the actuation member relative to the outer face plate. Actuation member 22 may also include at least one optional indicator 26 that provides visual confirmation of the selection of shower mode. Indicator 26 may be provided in combination with corresponding indices 28, 28*a* and 28*b* provided on outer face plate 20 (see FIG. 1, wherein index 28 refers to a first pulse only mode, index 28*a* refers to a combination spray/pulse mode and index 28*b* refers to a third spray only mode, as further described hereinbelow). The indices are not limited to the number and configuration shown in FIG. 1 and may employ any combination of colors, pictures, tactile elements or the like to ensure alignment between at least one indicator 26 and a selected index (thereby ensuring corresponding selection of the desired spray mode).

Operation of actuation member 22 effects selection of the desired flow rates for showerhead 10 as further described hereinbelow. Ball joint 14 includes a filter 30 disposed therein and a nozzle 32 defined therethrough. Ball joint 14 has a proximal extent 14*a* fixed to a fluid delivery conduit (i.e., a cantilever-type arm, not shown) that establishes fluid communication between a water delivery source and ball joint 14. Water entering ball joint 14 in the direction shown in FIG. 3 traverses filter 30, whereupon the filter removes undesirable effluents from water passing therethrough. Water exits ball joint 14 at nozzle 32 that is disposed at ball joint distal extent 14*b* for consistent and predictable delivery to showerhead 10, regardless of the orientation of housing 12 relative to the ball joint. An interfering sealing means such as O-ring 29 is desirably disposed adjacent ball joint distal extent 14*b* to impede showerhead rotation upon operation of actuation member 22.

Shell nut 16 has a proximal extent 16*a* adjacent ball joint 14 and an opposed bottom extent 16*b* adjacent main shell 18. Proximal shell nut extent 16*a* and distal shell nut extent 16*b* have a coextensive wall 16*c* of predetermined height defined by an outer peripheral surface 16*c*' and an inner peripheral surface 16*c*". An annular rim 16*d* provided at proximal shell nut extent 16*a* engages ball joint 14 such that ball joint 14 is pivotably received in a receiving region 16*e* defined by inner peripheral surface 16*c*". Orientation of showerhead 10 is effected by manual pivoting of the showerhead relative to the fixed ball joint (although electronic positioning means may be employed as is known in the art).

Figure 2:
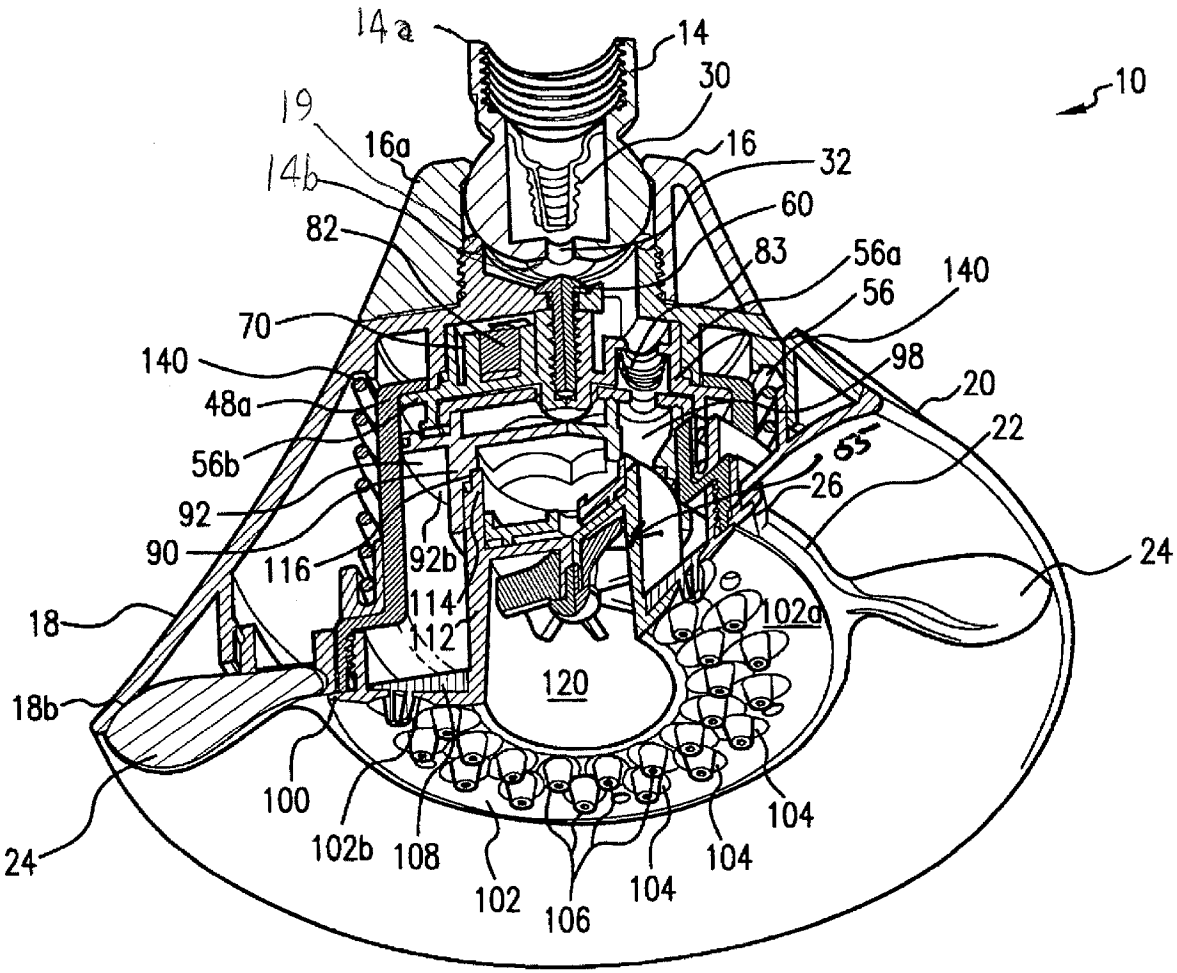
FIGS. 2 and 3 show sectional and front sectional views, respectively, of the multifunction showerhead of FIG. 1.
Figure 3:
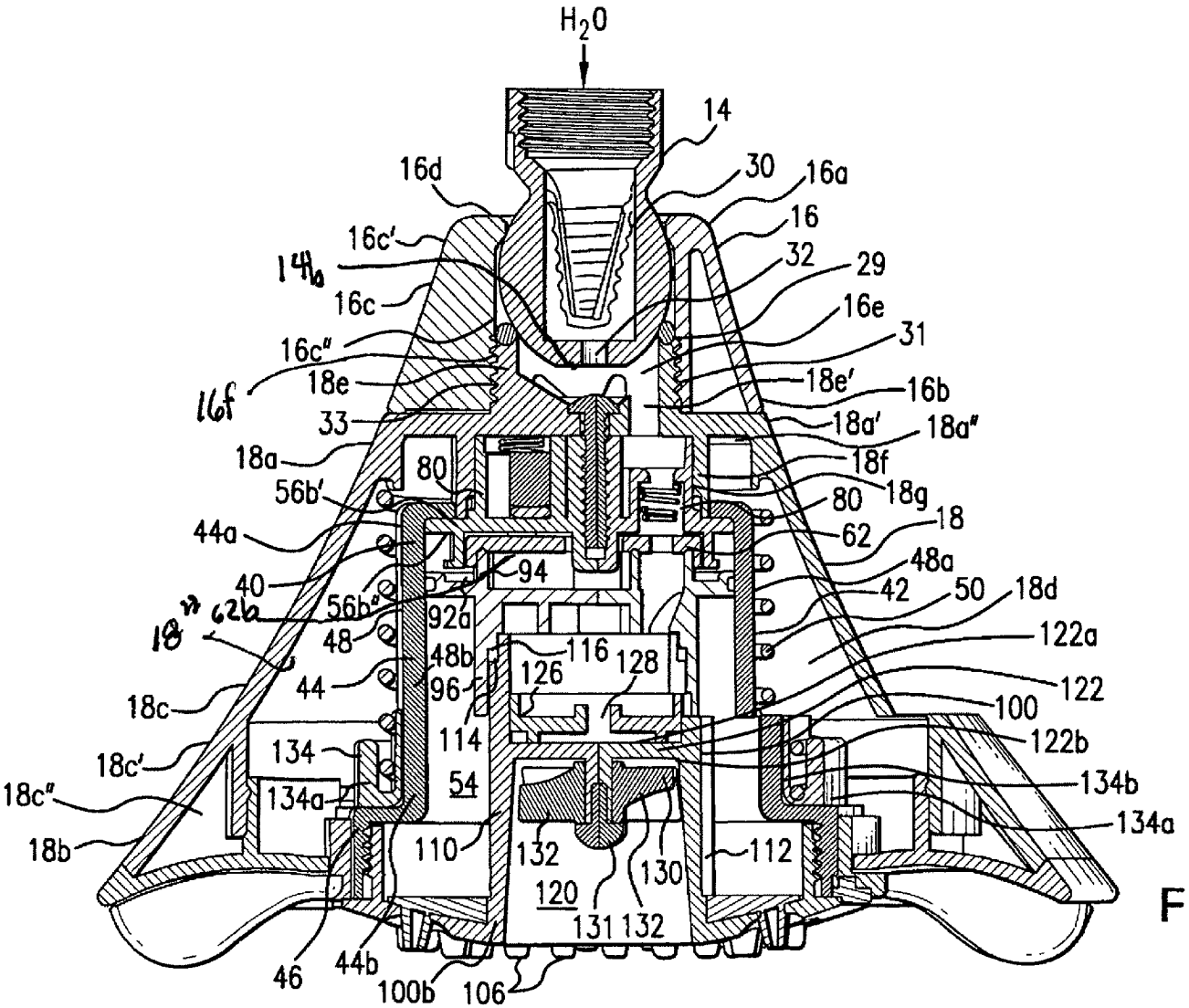

If shell nut 16 and main shell 18 are not constructed as an integral unit, inner peripheral surface 16*c*" may also include means for engagement of the shell nut and the main shell. As shown in FIGS. 2 and 3, inner peripheral surface 16*c*" has an annular shoulder 16*f* that engages a corresponding annular extension 18*e* on main shell 18 (as further described hereinbelow) with a sealing member such as O-ring 29 disposed adjacent such engagement to obstruct flow of water thereat. Such configuration ensures engagement of shell nut 16 with main shell 18 and may be further secured with selective application of an adhesive or epoxy. Additional engagement means is shown in the form of a plurality of threads 31 provided along inner peripheral surface 16*c*" for engagement with corresponding threads 33 on annular extension 18*e*. Engagement of shell nut 16 and main shell 18 is not limited to the aforementioned and described securement methods, and any known engagement means may be employed that accommodates successful operation of the present invention.

Bottom shell nut extent 16*b* is supported adjacent a top extent 18*a* of main shell 18 and more particularly a top surface 18*a*' thereof. Top main shell extent 18*a* and an opposed bottom extent 18*b* have a coextensive, generally frustoconical wall 18*c* of predetermined height defined therebetween (although wall 18*c* can assume any known geometry that is amenable to the practice of the present invention). Main shell wall 18*c* has an outer peripheral surface 18*c*' upon which desired aesthetic effects are provided (including but not limited to finishes, etchings, appliqués and any combination thereof) and an inner peripheral surface 18*c*" delineating a main housing region 18*d* in which the operational elements of showerhead 10 are lodged (as further described hereinbelow).

An annular extension 18*e* protrudes generally normally relative to main shell top surface 18*a*' and has a lumen 18*e*' to accommodate water flow therethrough. Main shell top surface 18*a*' supports bottom shell nut extent 16*b* such that receiving region 16*e* of shell nut 16 accommodates annular extension 18*e* therein, such accommodation being effecting by threaded engagement, snap-fit engagement, epoxy or alternative comparable means as described hereinabove.

Top main shell extent 18*a* further includes an opposed bottom surface 18*a*" from which a depending extension 18*f* protrudes generally normally. Depending extension 18*f* has a receiving aperture 18*g* defined therein that accommodates additional elements of showerhead 10 (as further described below) Annular extension 18*e* and depending extension 18*f* are concentrically arranged such that an unoccluded fluid flow path is provided from ball joint 14 to depending extension 18*f* and more particularly to cartridge assembly 40 adjacent thereto.

Figure 5:
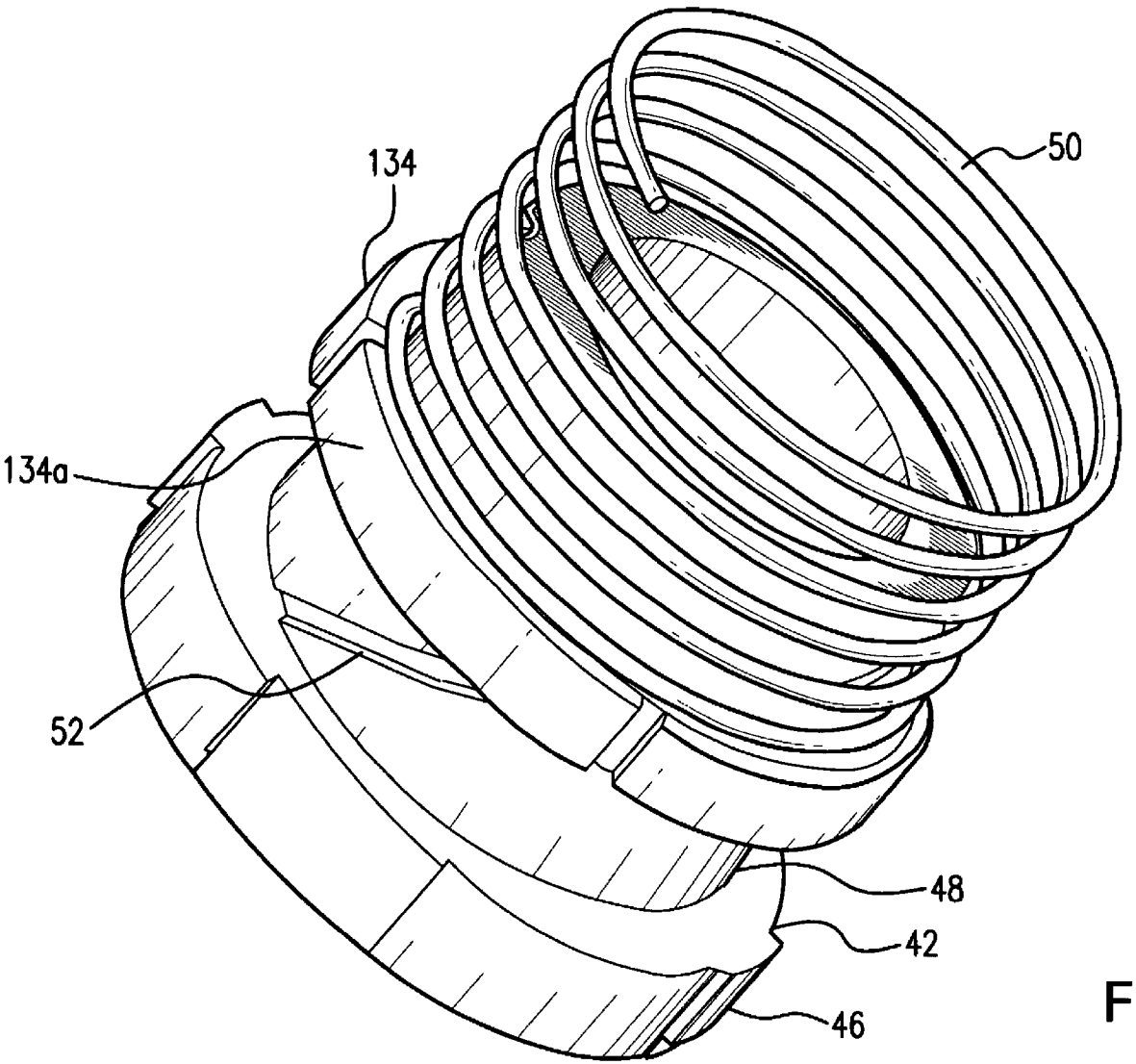
FIG. 5 shows a perspective view of a cartridge housing and reverse ring assembly used in the multifunction showerhead of the present invention.

Cartridge assembly 40 includes a cartridge housing 42 having an elongate cylindrical body 44 that terminates at an annular flange 46 provided at a distal extent 44*b* thereof. A generally cylindrical wall 48 of predetermined length extends from distal extent 44*b* to an opposed proximal extent 44*a* and is coextensive therewith. Cartridge body wall 48 has an outer peripheral surface 48*a* along which a biasing spring 50 is coaxially disposed and in which a guide recess 52 is provided in a generally helical configuration along at least a portion of the length of cartridge body wall 48 (see FIG. 5).

Cartridge body wall 48 also has an inner peripheral surface 48*b* that delineates an operating region 54 wherein operable members 55 of cartridge assembly 40 are lodged. A generally annular cartridge holder 56 is provided in operating region 54 at cartridge body proximal extent 44*a* such that an annular wall 56*a* of cartridge holder 56 is coaxially disposed relative to annular extension 18*e* and depending extension 18*f* (see FIGS. 2 and 3). Cartridge holder 56 is removably fastened in receiving aperture 18*g* via insertable or snap tight engagement, threaded engagement (such as threaded screw member 60 shown in FIGS. 2 and 3), adhesive engagement or by any fastening means that is known in the art for assembling showerhead components. An axial lumen defined through cartridge holder 56 accommodates screw member 60 or a like fastening member thereby.

Figure 6:
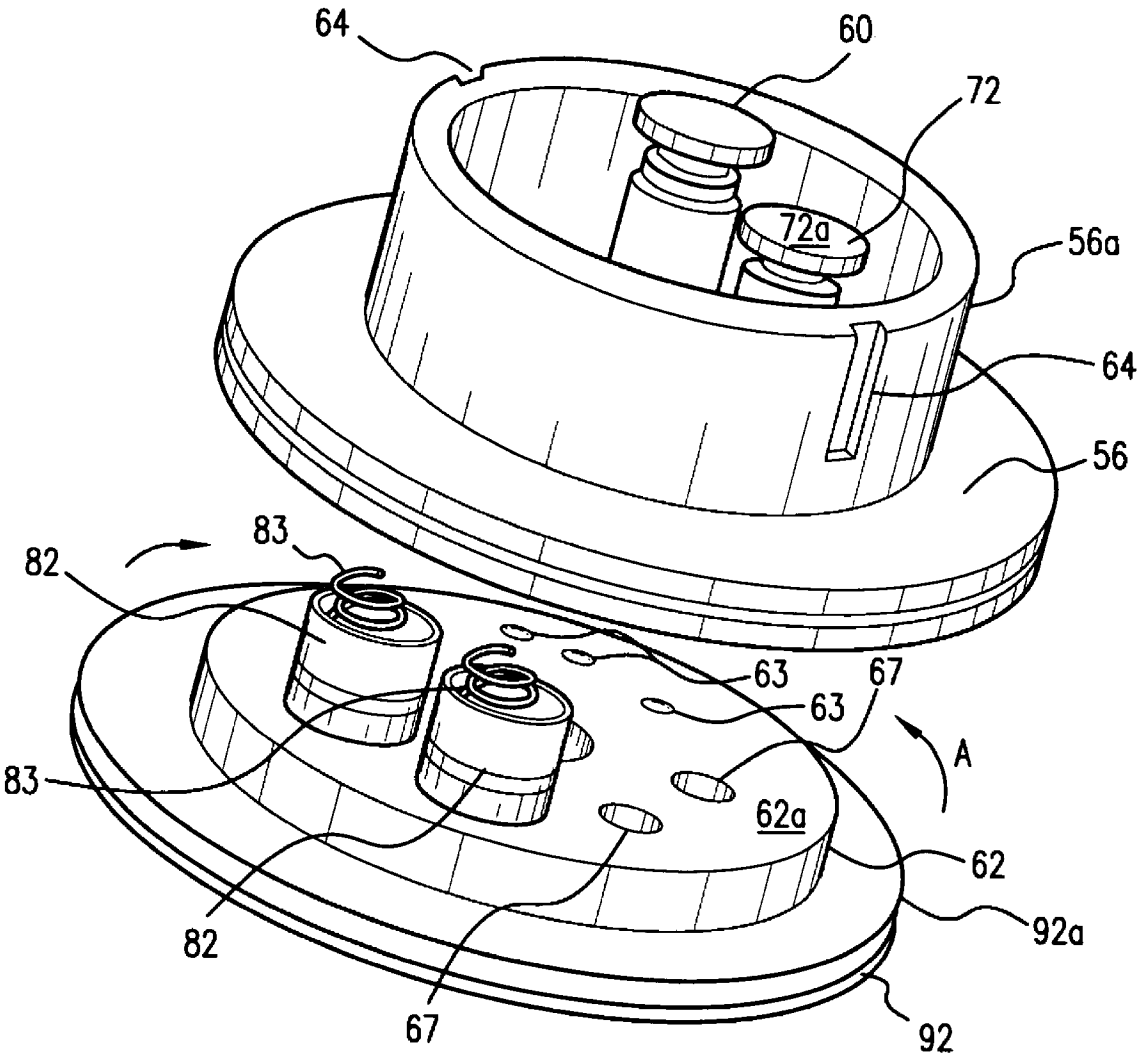
FIG. 6 shows an enlarged schematic view of a cartridge assembly and cartridge disc used in the multifunction showerhead of the present invention.

Annular cartridge holder wall 56*a* depends upwardly from an annular flange 56*b* having a top surface 56*b*' that communicates with depending extension 18*f* and a bottom surface 56*b*" in communication with an adjacent cartridge disc 62. As further shown in FIG. 6, one or more notches or recesses 64 may be defined along an outer surface of cartridge holder annular wall 56*a* for cooperating engagement with at least one corresponding flange provided in receiving aperture 18*g* for additional securement of cartridge holder 56 in cartridge assembly 40. In addition, a sealing member such as an O-ring may be placed adjacent annular flange 56*b* or bottom surface 56*b*" thereof for additional sealing benefits.

Figure 7:
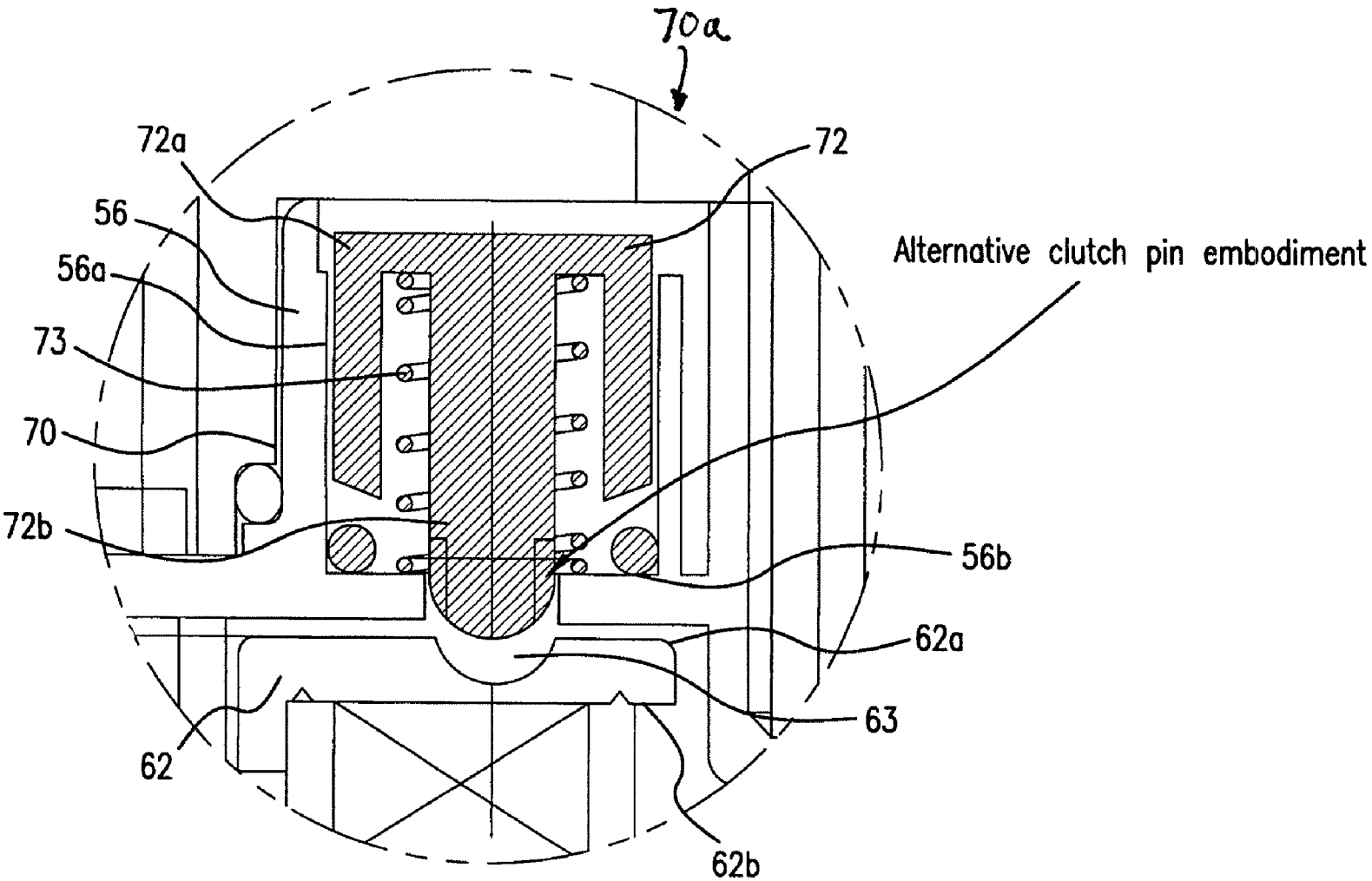
FIG. 7 shows an enlarged partial sectional view of a clutch pin and detent feature used with the multifunction showerhead of the present invention.
Figure 8:
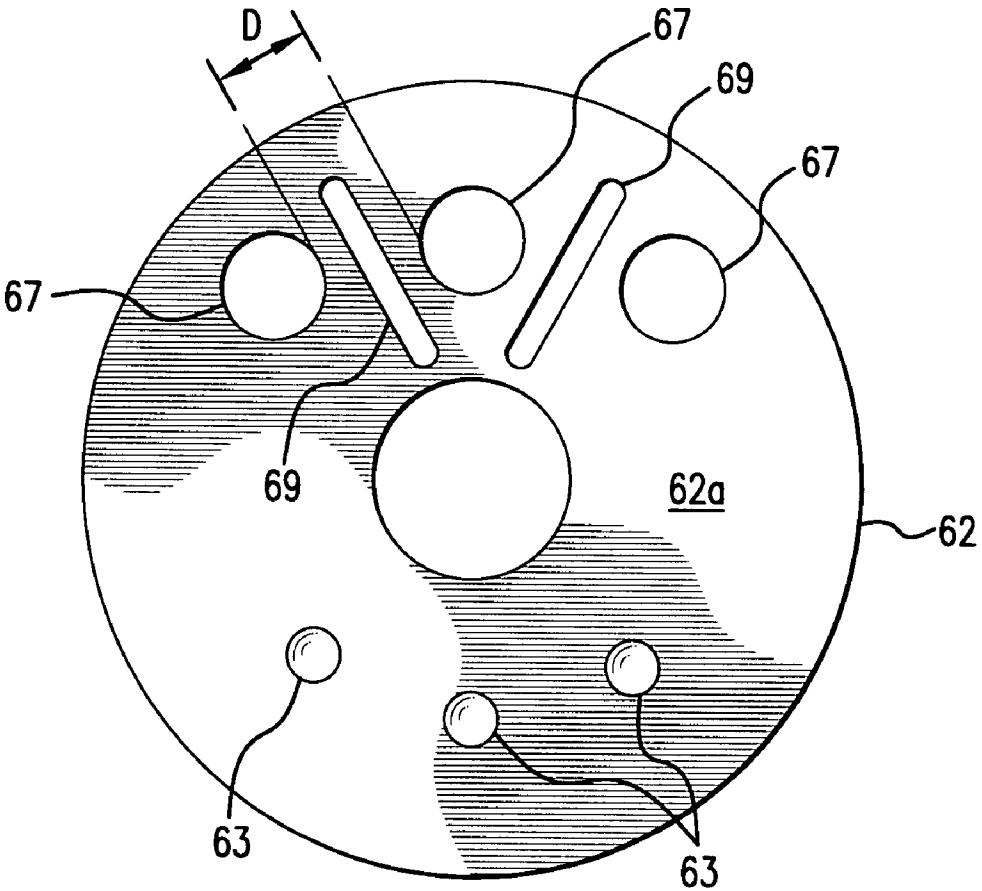
FIG. 8 shows a top view of a cartridge disc with detent recesses used in the multifunction showerhead of the present invention.

Referring to FIGS. 7 and 8, a clutch operating region 70 having a clutch 70*a* is provided that is offset from the axial lumen defined in cartridge holder 56. The parameters of clutch operating region 70 are delineated by annular wall 56*a* and flange top surface 56*b*'. A clutch pin 72 is provided in clutch operating region 70 having a head portion 72*a* and a depending tail portion 72*b* along which a spring 73 is provided in operable communication with the clutch pin. Clutch pin 72 engages cartridge disc 62 and more particularly at least one recess 63 defined in a top surface 62*a* thereof). Top disc surface 62*a* desirably includes a plurality of recesses 63 that accommodate placement of clutch pin 72 therein and may selectively include at least one groove 69. Each groove 69 accommodates fluid runoff of top disc surface 62*a* and thereby alleviates undesirable fluid pressure thereat. Although clutch pin tail portion 72*b* is shown as having a generally rounded extent that cooperates with a corresponding recess 63, it is understood that tail portion 72*b* can assume alternative embodiments (as shown in FIG. 7) for cooperation with the cartridge disc recess.

Movement of cartridge disc 62 relative to cartridge holder 56 during operation of showerhead 10 adjusts the position of each recess 63 relative to clutch pin 72. In each position, the operation of showerhead 10 changes to achieve a desired and predictable shower pattern. The inclusion of a detent feature, which is triggered upon operation of actuation member 22 and enhanced by alignment with indices 28, 28*a* and 28*b*, provides an audible and tactile feedback to the bather upon selection of the desired shower mode.

Cartridge disc 62 with detent recesses 63 defined thereon, is designed such that the protrusion of clutch pin tail portion 72*b* will align with corresponding recesses 63. The action of cartridge disc 62 is such that as the cartridge disc rotates upon rotation of actuation member 22, thereby pushing clutch pin 72 inward along spring 73. As actuation member 22 reaches an indexed location, clutch pin tail portion 72*b* is biased by spring 73 into a detent recess 63. This results in a physical "snap" action that is felt and heard by the bather, thereby providing sensory confirmation of proper selection of the desired spray mode.

Also offset from the axial lumen is at least one, and desirably two, sealing regions 80 provided in cartridge holder 56. Each sealing region 80 has a resilient cup seal member 82 disposed therein in combination with a spring 83 (see FIG. 6). Each cup seal member 82 comes into alternating registry with at least one corresponding aperture 67 defined through cartridge disc 62 as cartridge disc 62 rotates relative to fixed cartridge holder 56 when showerhead 10 is in operation. In a preferred embodiment shown in detail in FIG. 8, three apertures 67 are provided in cartridge disc 62 such that consecutive apertures are separated by a minimum predetermined distance D. Springs 83 disposed along cup seal members 82 eliminate the need for a separate check valve and thereby eliminate the expense and maintenance associated with such check valves to the benefit of the manufacturer, installer and consumer.

A cartridge 90 that is also provided in operating region 54 is coaxially disposed relative to cartridge housing 42 and detachably fastened thereto such that rotation of cartridge disc 62 remains unimpeded. Cartridge 90 has an annular flange 92 with a top surface 92*a* in communication with a bottom surface 62*b* of cartridge disc 62 and an opposed bottom flange surface 92*b*. Top flange surface 92*a* has an upper annular wall 94 extending upwardly therefrom, and bottom flange surface 92*b* has a lower annular wall 96 extending generally downwardly therefrom. Upper annular wall 94 delineates at least one fluid ingress 98 therein to accommodate fluid flow through a cartridge aperture 67 in alignment therewith. At least one such fluid ingress 98 may selectively have a flow regulator disposed thereat that is selected from one of a plurality of commercially available flow regulators such as those sold under the trademark NEOPERL (NEOPERL is a registered trademark of Neoperl Servisys AG Corporation, Switzerland).

Lower annular wall 96 further delineates an engagement region wherein a face plate 100 is detachably secured. Face plate 100 has a distal extent 100*b* at which an annular face portion 102 is provided. Annular face portion 102 includes fluid delivery surface 102*a* having a plurality of fluid delivery ports 104 defined therethrough. Fluid delivery ports 104 accommodate insertion of corresponding nozzles 106 therethrough, which nozzles may be dispersed along an annular nozzle ring 108. Nozzle ring 108 is disposed adjacent a fluid impingement surface 102*b* opposed to fluid delivery surface 102*a* of annular face portion 102 and may be secured via a water-repellant epoxy or equivalent means. Securement of face plate 100 with cartridge assembly 40 (or more particularly with cartridge housing 12 as shown in FIG. 3) may be effected by threaded engagement as shown or alternatively by any known securement means that is amenable to the practice of the present invention.

Face plate 100 further includes a cylindrical extension 110 depending from fluid impingement surface 102*b*. Extension 110 has an outer peripheral surface 112 with an annular shoulder 114 defined thereat for engagement with a corresponding annular shoulder 116 defined at a distalmost extent of lower annular cartridge wall 96. A predefined gap x is provided between face plate extension shoulder 114 and annular shoulder 116 to accommodate elevation of the former relative to the latter during operation of showerhead 10 (see FIG. 7). In the alternative, corresponding threads may be defined along outer peripheral surface 112 and an inside peripheral surface of cartridge wall 96 for mutual threaded engagement.

A lumen 120 defined in face plate extension 110 terminates in a platform 122 having an upper surface 122*a* and a lower surface 122*b*. Upper platform surface 122*a* supports a compression plate 126 thereon that biases face plate 100 toward cartridge housing distal extent 44*b* (see FIGS. 2 and 3). Compression plate 126 has an axial aperture 128 defined therethrough that establishes fluid communication with at least one fluid aperture defined through platform 122.

A rotating turbine member 130 is affixed to platform 122 via a rivet 131 or comparable fixation member such that fluid flows through the platform apertures (not shown) and impinges turbine blades 132, consequently causing rotation of turbine member 130. Showerhead 10 desirably employs a turbine as taught by U.S. Pat. No. 7,066,407 to Lu (hereinafter referred to as "Lu" and incorporated in its entirety by reference herein). Lu shows a shower head assembly having an outer housing with an inner housing mounted thereon. The inner housing includes a mediate portion characterized by a separation wall having a plurality of ejection holes through which water passes. A catch cap disposed on a first side of the separation wall has an air chamber in communication with the ejection holes and further in communication with a water inlet hole. An impeller is rotatably mounted on a second side of the separation wall and has a plurality of blades selectively aligning with the ejection holes. The impeller is rotatably mounted on a pivot shaft and removably mounted thereon by a fastener such as a retaining pin. In operation, water from a water delivery source travels to a universal connector passage for delivery to the inner housing. Water further traverses the water inlet hole, the air chamber, the ejection holes and the impeller for outward radial ejection from the outer housing and delivery to a bather. As the water flow causes rotation of the impeller, water drops outward along the blades in discrete portions to provide an enjoyable fluttering effect for the bather. This fluttering effect is achieved at a constant flow rate of no more than 2.0 GPM when used as the sole water delivery mechanism (although water delivery is limited to no more than 1.5 GPM when the second combined spray mode is selected, as further described hereinbelow). Thus, introduction of the water flow through the water inlet hole into the air chamber reduces the water flow rate to achieve water conservation benefits. In addition, water is ejected from the ejection holes in an atomized manner to create a pleasing tactile spray for the bather.

Figure 4:
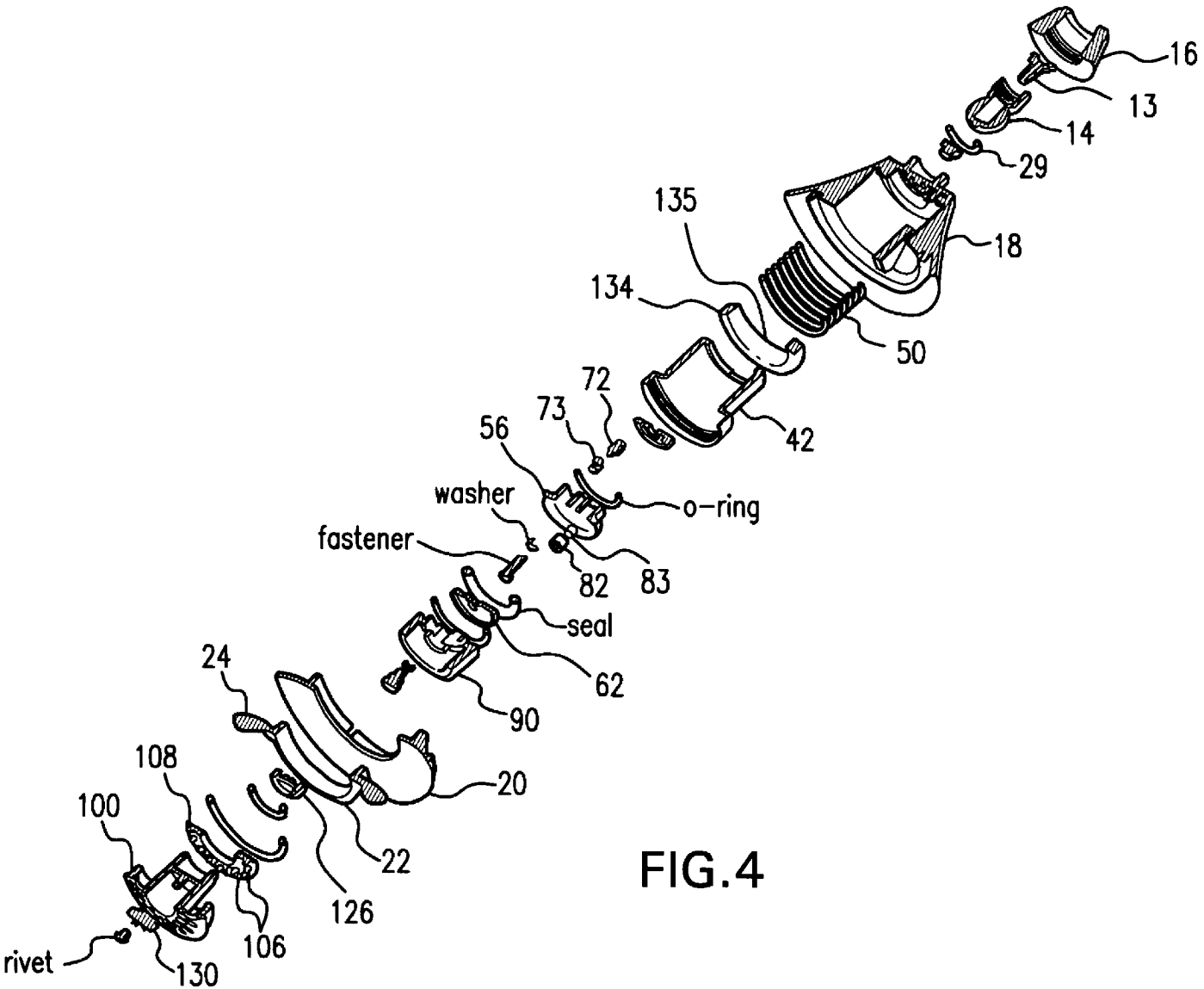
FIG. 4 shows an exploded half-sectional view of the multifunction showerhead of FIG. 1.

A reversing mechanism such as reverse ring 134 is disposed along cartridge body wall 48 and supported by annular flange 46 when showerhead 10 is not in operation. Reverse ring 134 is generally an annular member having an outer wall 134*a* and an inner wall 134*b* having an engagement means such as inclined notch 135 integrally defined thereon (see FIGS. 4 and 5). Notch 135 cooperates with a corresponding guide means such as helical guide recess 52 defined on cartridge body wall 48. In this configuration, actuation of rotatable actuation member 22 compresses biasing spring 50 and thereby effects linear displacement of the reverse ring relative to the cartridge body wall (and consequent rotation of cartridge disc 62 to effect successive alignment of recesses 63 relative to clutch pin 72 and obtain a desired spray mode thereby).

A user of showerhead 10 may select from one of three different flow rates for delivery of desired water massage action without compromise of water conservation benefits. Referring to FIG. 1, in the first fluttering spray, "optimal water saver" mode (designated by index 28), clutch pin 72 is in registry with a detent recess 63 such that a cup seal member 82 is in registry with one cartridge disc aperture 67. In this first mode, no more than about 2.0 GPM (5.7 L/min) at 80 PSI is delivered to turbine member 130. In the second combination fluttering and precision spray mode (designated by index 28*a*), rotation of cartridge disc 62 in the direction of arrow A (see FIG. 6) brings clutch pin 72 into registry with a second detent recess 63 that corresponds to placement of two cup seal members in registry with two corresponding cartridge disc apertures 67. In this second mode, no more than about 1.5 GPM (5.7 L/min) is delivered to turbine member 130 (as provided in the first mode) and no more than about 1.0 GPM (3.8 L/min) is delivered to spray nozzles 106 simultaneously. In the third precision spray mode (designated by index 28*b*), further rotation of cartridge disc 62 in the direction of arrow A causes clutch pin 72 to engage a third detent recess 63 that corresponds to a third "spray only" mode in which water is delivered at no more than about 2.5 GPM (9.5 L/min) to spray nozzles 106. All of these modes are operated in a normal pressure range of about 20 to 80 psi to ensure that a cumulative water amount of no more than about 2.5 GPM (9.6 L/min) is ever delivered during use of showerhead 10. Apertures 67 overlap fluid ingress 98 by a predetermined parameter to ensure controlled leakage and thereby alleviate pressure between cartridge disc 62 and cartridge holder 56.

In operation, showerhead 10 is initially in the first mode wherein water is initially delivered at no more than about 1.5 GPM to turbine member 130 to derive a concentrated fluttering spray effect therefrom. Pressure incurred by the water flow forces clutch pin 72 down into a first detent recess 63 corresponding to alignment of a first sup seal member 82 with a first cartridge disc aperture 67. In order to change from the first mode to the second mode, a user operates actuation member 22 so as to rotate actuation member 22 and correspondingly rotate cartridge housing 44. Consequently, reverse ring 134, and particularly notch 135 thereof, traverses guide recess 52 to compress biasing spring 50. Elevation of reverse ring 134 relative to cartridge housing wall 48 is limited by stops 140 defined in main shell housing region 18*d* (see FIGS. 2 and 3).

As cartridge housing 44 rotates, so does face plate 100 and cartridge 90 in engagement therewith. Such rotation in turn rotates cartridge disc 62. As spring 50 compresses, pressure on clutch pin 72 is reduced to accommodate rotation of cartridge disc 62 relative to clutch pin 72 and subsequent engagement of a second detent recess 63 corresponding to the second mode. Upon turning actuation member 22, a user will tactilely experience such engagement between clutch pin 72 and consecutive detent recesses 63 so as to know when a successful selection of modes has been achieved. If further selection of showerhead modes is desired, the user will again operate actuation member 22 and feel the engagement of clutch pin 72 with a third detent recess 63 as water continues to flow through showerhead 10 and induce pressure on clutch pin 72. At the conclusion of a shower event and discontinuance of water delivery, there is no such water pressure on clutch pin 72. Spring 50 thereby biases clutch pin 72 to its initial rest position in the first water saver mode and releases clutch pin 72 from its position in the second or third detent recess 63. Simultaneously, compression plate 126 biases cartridge assembly 40 toward the assembly's starting position, thereby relieving compression of spring 50 and guiding reverse ring 134 along guide recess 52 back to its initial starting position supported by annular flange 46. When water pressure drops below a predetermined bottom threshold (such as upon cessation of the shower), showerhead 10 thereby automatically returns to the first operational mode to ensure water conservation during all subsequent shower events.

Showerhead 10, or any portion thereof, is selectively fabricated from metals, plastics, composites or any combination thereof that is amenable to practice of the present invention. One or more of housing 12 and cartridge assembly 40 may be produced as integral elements, ultrasonically welded or mechanically assembled for ease of manufacturability and assembly. Showerhead 10, or any portion thereof, may also have one or more treatments applied thereon to enhance the showerhead's performance. Such treatments may include coatings, glazes and/or additives having one or more of hydrophobic, hydrophilic, antimicrobial, antibacterial, biocidal, odor suppressing, anti-viral and algicidal properties. Such coatings are well known within the industry to promote the cleanliness of sanitary fittings and fixtures and to deter the transmission of undesirable contagions.

The present invention showerhead delivers a stark improvement in water conservation efforts by permitting selection of various shower effects without attenuating the device water conservation benefits. No showerhead in the existing art discloses a showerhead that delivers different flow rates for different spray functions such that each spray function has a predetermined maximum water flow rate. Such art further does not show aggregate flow rates for a combination spray that does not exceed a predetermined maximum flow rate for the entire showerhead. The showerhead of the present invention, however, is desirably provided in multiple aesthetic embodiments, all of which accommodate a first concentrated fluttering spray mode at a first water saver flow rate; a second spray mode that combines the first spray pattern with a second radially dispersed precision spray pattern having a second water flow rate that exceeds the first water flow rate, and a third mode that delivers the radially dispersed precision spray pattern at the second water flow rate. The cumulative flow rate of the second mode never exceeds the second, higher water flow rate. In this manner, the present invention provides the bather with a selection of desirably spray functions that are tactilely pleasing, yet restrains the total consumption of water for each shower event. This is achieved in concert with the automatic return feature which further eliminates wasteful consumption of precious water resources.

The showerhead of the present invention further obviates any override of the showerhead's beneficial features. In conventional showerheads, the flow control device can be overridden or rendered ineffective by the installer or user. The flow control devices of the present invention showerhead, however, are disposed deep within the showerhead housing to eliminate tampering thereof. This feature inures to the present invention's benefit of successfully communicating with a preexisting bath shower control valve upon the fall of water pressure below a predetermined bottom threshold (typically below 20 PSI).

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

We claim:

1. A multifunction showerhead with automatic return function, comprising:

a housing having:

a shell nut with a proximal extent, an opposed distal extent and a coextensive wall therebetween;

a main shell portion having a top extent adjacent the distal extent of the shell nut, an opposed bottom extent and a coextensive wall having an inner surface defining a main housing region thereby; and an outer face plate provided at the opposed bottom extent of the main shell portion and having an actuation member operative adjacent thereto, the outer face plate having a distal extent for fluid delivery;

a cartridge assembly having:

a cartridge housing, the cartridge housing having an elongate cartridge body with a proximal extent, an opposed distal extent and a coextensive cartridge body wall therebetween, the cartridge body wall having an outer peripheral surface having a biasing spring disposed thereat, wherein along at least a portion of the outer peripheral surface a guide recess is defined, the cartridge body wall also having an inner peripheral surface that defines an operating region wherein operable members of the cartridge assembly are lodged;

a cartridge holder in detachable engagement with the main shell portion and the cartridge body, the cartridge holder having a proximal extent proximate the proximal extent of the main shell portion, an opposed distal extent proximate the proximal extent of the cartridge body, and a wall coaxially disposed relative to the cartridge body, the cartridge holder having an axial lumen and, offset therefrom, a clutch operating region and at least one sealing region wherein a clutch is operatively disposed in the clutch operating region and a sealing member is operatively disposed in the at least one sealing region;

a cartridge coaxially disposed relative to the cartridge housing and the cartridge holder, the cartridge having at least one fluid ingress therein to accommodate fluid flow through a cartridge aperture in alignment therewith; and a rotatable cartridge disc having a top surface proximate a bottom surface of the cartridge holder and a bottom surface proximate a top surface of the cartridge, the cartridge disc being coaxially disposed relative to the cartridge housing, the cartridge holder and the cartridge, wherein at least one detent recess is defined on the top surface of the cartridge disc for selective engagement by the clutch, the at least one detent recess being in operable communication with the actuation member to provide audible and tactile feedback upon activation thereof, the cartridge disc further having at least one aperture defined therethrough; wherein the biasing spring in operable communication with the actuation member effects rotation of the cartridge disc for engagement of at least one of the at least one detent recess by the clutch to obtain a desired spray mode thereby;

wherein the desired spray mode comprises at least one of a first fluttering spray operating mode, a second combined fluttering and precision spray operating mode and a third precision spray operating mode; and the showerhead further comprises an automatic return that functions to return the showerhead to the first operating mode when water pressure to the showerhead falls below a predetermined bottom threshold.

2. The multifunction showerhead according to claim 1, wherein in the first operating mode, the showerhead delivers water to a fluttering spray delivery means; in the second operating mode, the showerhead delivers water to the fluttering spray delivery means and simultaneously delivers water to a fluid delivery means; and in the third operating mode, the showerhead delivers water to the fluid delivery means.

3. The multifunction showerhead according to claim 2, wherein the fluttering spray delivery means comprises an impeller having a plurality of blades, the impeller being driven by impingement of water upon the blades and delivering discrete water volumes therefrom.

4. The multifunction showerhead according to claim 1, wherein the showerhead automatic return further comprises a reversing mechanism having an outer wall, an inner wall and an engagement means defined along the inner wall corresponding to the cartridge housing guide recess, the reversing mechanism being disposed adjacent the outer peripheral surface of the cartridge housing wall.

5. The multifunction showerhead according to claim 3, wherein the cartridge housing guide recess and the reversing mechanism engagement means are in engagement upon operation of the actuation member.

6. The multifunction showerhead according to claim 5, wherein the recess is a helical recess.

7. The multifunction showerhead according to claim 5, wherein the engagement means comprises a notch corresponding to the recess.

8. The multifunction showerhead according to claim 3, wherein the biasing spring is coaxially disposed relative to the cartridge housing wall and in operable communication with the reversing mechanism.

9. The multifunction showerhead according to claim 8, wherein the showerhead automatic return further comprises a compression plate that biases the cartridge assembly and relieves the biasing spring to guide the reversing mechanism along the cartridge housing guide recess when water pressure to the showerhead falls below the predetermined bottom threshold.

10. The multifunction showerhead according to claim 9, wherein the predetermined bottom threshold does not exceed 20 PSI.

11. The multifunction showerhead according to claim 1, wherein the clutch comprises a clutch pin having a head portion and a depending tail portion, the tail portion accommodating the biasing spring along at least a portion of the depending tail portion, wherein the depending tail portion has an extent for selective engagement with at least one of the at least one detent recess during rotation of the cartridge disc.

12. The multifunction showerhead according to claim 1, wherein the at least one detent recess corresponds to the at least one desired spray mode such that selective engagement of the at least one recess by the clutch upon rotation of the cartridge disc provides an audible and tactile indication of selection of the corresponding desired spray mode.

13. The multifunction showerhead according to claim 12, wherein the cartridge disc further includes at least one water runoff groove defined along a surface thereof.

14. The multifunction showerhead according to claim 1, wherein the sealing member comprises a resilient cup seal member disposed in each of the at least one sealing region with a spring in operable communication therewith.

15. The multifunction showerhead according to claim 14, wherein each of the cup seal members comes into alternating registry with the at least one detent recess defined in the cartridge disc as the cartridge disc rotates relative to the cartridge holder.

16. The multifunction showerhead according to claim 1, wherein the face plate is detachably secured to the cartridge.

17. The multifunction showerhead according to claim 16, wherein the face plate provides fluid delivery through a plurality of fluid delivery ports defined through the distal extent of the face plate.

18. The multifunction showerhead according to claim 17, wherein the showerhead further comprises a plurality of nozzles corresponding to the plurality of fluid delivery ports and inserted therethrough.

19. The multifunction showerhead according to claim 18, wherein the plurality of nozzles is dispersed along an annular nozzle ring disposed adjacent the distal extent of the face plate.

20. The multifunction showerhead according to claim 16, wherein the face plate includes an extension in engagement with the cartridge so as to define a gap that accommodates elevation of the face plate extension relative to the cartridge during operation of the showerhead.

21. The multifunction showerhead according to claim 1, wherein the actuation member is in rotatable registry with the outer face plate.

22. The multifunction showerhead according to claim 21, wherein the actuation member includes at least one grasping portion that is able to accommodate placement of one or more digits thereon to effect rotation of the actuation member relative to the outer face plate.

23. The multifunction showerhead according to claim 1, wherein the outer face plate includes at least one indicator thereon corresponding to the at least one desired spray mode.

24. The multifunction showerhead according to claim 23, wherein the at least one indicator is selected from visual indicators, audible indicators, tactile indicators and combinations thereof.

25. The multifunction showerhead according to claim 1, wherein the at least one fluid ingress in the cartridge has a flow regulator disposed thereat.

26. The multifunction showerhead according to claim 1, wherein the showerhead, or any portion thereof, comprises a material selected from metal, plastic, composite, and combinations thereof.

27. The multifunction showerhead according to claim 1, wherein at least a portion of the showerhead has at least one treatment applied thereon, the treatment selected from coatings; glazes; and additives having one or more of hydrophobic, hydrophilic, antimicrobial, antibacterial, biocidal, odor suppressing, anti-viral and algicidal properties; and combinations thereof.

* * * * *